US009220925B2

(12) United States Patent
Gilg et al.

(10) Patent No.: US 9,220,925 B2
(45) Date of Patent: Dec. 29, 2015

(54) DEVICE FOR THE PRODUCTION OF LIPSTICK LEADS WITH A FLEXIBLE MOLD

(71) Applicant: Weckerle GmbH, Weilheim (DE)

(72) Inventors: Franz Xaver Gilg, Polling (DE); Sven Droste, Peiβenberg (DE)

(73) Assignee: Weckerle GMBH (DE)

( * ) Notice: Subject to any disclaimer, the term of this patent is extended or adjusted under 35 U.S.C. 154(b) by 0 days.

(21) Appl. No.: 14/095,260

(22) Filed: Dec. 3, 2013

(65) Prior Publication Data

US 2014/0151927 A1 Jun. 5, 2014

(30) Foreign Application Priority Data

Dec. 4, 2012 (EP) ..... 12195402

(51) Int. Cl.
*A61Q 1/06* (2006.01)
*A45D 40/16* (2006.01)

(52) U.S. Cl.
CPC . *A61Q 1/06* (2013.01); *A45D 40/16* (2013.01)

(58) Field of Classification Search
CPC ..... A41Q 1/06; B29C 33/04; B29C 33/0011; B29C 33/40; B29C 33/50; A45D 40/16
USPC ..... 264/334, 138; 425/441, 444
See application file for complete search history.

(56) References Cited

U.S. PATENT DOCUMENTS

2004/0137101 A1* 7/2004 Avalle ..... 425/117
2007/0295887 A1* 12/2007 Kuo ..... 249/137

FOREIGN PATENT DOCUMENTS

EP 0686468 B1 12/1995
EP 1437062 A1 7/2004
FR 2729278 A1 7/1996

OTHER PUBLICATIONS

European Search Report, May 7, 2013, 4 pages.

* cited by examiner

*Primary Examiner* — Jacob Thomas Minskey
(74) *Attorney, Agent, or Firm* — Warner Norcross & Judd LLP

(57) ABSTRACT

A device and a method for the production of lipstick leads made of paste-like masses where, the device includes a chamber, a flexible mold part and a mold holder, and the flexible mold part is arranged in the chamber and paste-like mass is poured into the flexible mold part and can at least partially solidify in the flexible mold part and the at least partially solidified paste-like mass is removed with a removal device while elastically expanding the flexible mold part, and the mold holder is arranged for at least some of the time and at least partially in the chamber for holding part of the flexible mold part, so that the mold holder is moved relative to the flexible mold part, and the chamber can be filled with a heat transfer medium before and/or during the filling of the flexible mold part, and a negative pressure expands the flexible mold part in the chamber to remove the paste-like mass.

10 Claims, 2 Drawing Sheets

DEVICE FOR THE PRODUCTION OF LIPSTICK LEADS WITH A FLEXIBLE MOLD

TECHNICAL FIELD

The present invention relates to a device for the production of lipstick leads made of paste-like masses, in particular a device of this kind with a flexible mold.

BACKGROUND

Devices and molds for the production of lipstick leads have been known for a long time. Thereby, either rigid or flexible molds are filled with a paste-like mass. The mass is subsequently solidified in the mold and removed from the mold.

Different devices and methods are known in the art, with the help of which an attempt is made to produce and remove a lipstick lead from the mold such that the visible part of the lipstick lead has a continuous and smooth surface.

EP 0 578 179 B1 and FR 2 443 324 each show a device which uses a flexible mold. With the device shown in FR 2 443 324, the mold consists of two parts. The visible part of the lipstick lead is formed with the help of the flexible mold and the rear part of the lipstick lead, which is arranged in the lipstick housing itself, is formed with the help of a rigid mold. To remove the lipstick lead, compressed air is fed between the lipstick lead and the flexible mold in order to release the lipstick lead from the flexible mold and to transport it through the rigid mold into the lipstick housing. However, with a lipstick lead which is produced in this way, there is a risk of the lipstick lead being damaged when it is removed from the mold. In addition, with the lipstick lead produced in this way, the boundary between the two molds is visible on the surface.

EP 0 686 468 B1 also describes the use of a flexible mold. To remove the lipstick lead, the flexible mold with the molded lipstick lead is arranged in a chamber. In the chamber is a holder made of a flexible material. In order to remove the lipstick lead from the mold with the help of a removal device, the bottom part of the flexible mold is held by the flexible holder, and the top part expanded. However, the flexible holder cannot ensure that no damage occurs to the surface of the lipstick lead during removal due to the removal device.

Furthermore, with the known devices, the production of lipstick leads takes a relatively long time, as the paste-like masses are poured into the molds in a warm, free-flowing state and must first of all cool down and solidify before the lipstick leads can be removed.

It is true that EP 0 686 468 B1 describes that the mold can be arranged in an appropriate device with heating or cooling means for heating and cooling in each case. However, as the mold has to be transported from a chamber with heating means into a chamber with cooling means and from there into a removal chamber for this purpose, heating and cooling means of this kind are not suitable for substantially reducing the production time of lipstick leads.

The object is therefore to provide a device and a method which do not have the disadvantages mentioned above. In particular, a lipstick lead, which has a continuous and smooth surface, is to be produced with the device and the method, and under the premise that the process time for the production and removal from the mold is as short as possible in order to guarantee an effective, high-quality and rapid production of lipstick leads. At the same time, the device must require as little maintenance as possible.

SUMMARY

According to the invention, this object is achieved by the device and the method according to the independent patent claims.

The device according to the invention for the production of lipstick leads made of paste-like masses has a chamber, at least one flexible mold part and at least one mold holder. The flexible mold part is arranged in the chamber. According to the invention, the flexible mold part is designed in such a way that the paste-like mass can be poured into the flexible mold part and can at least partially solidify in the flexible mold part. The at least partially solidified paste-like mass is then removed with the help of a removal device while elastically expanding the flexible mold part. The mold holder is arranged for at least some of the time and at least partially in the chamber and in doing so holds part of the flexible mold part. In other words, when the device according to the invention is used as intended, there is at least one instant in time when the mold holder is arranged at least partially in the chamber. The mold holder can also be moved relative to the flexible mold part so that there is also a position, for example in which the mold holder does not hold the mold part. If the chamber has a plurality of flexible mold parts, then a plurality of mold holders can also be provided.

The chamber of the device according to the invention is designed in such a way that the chamber can be filled with a heat transfer medium before and/or during and/or after the filling of the at least one flexible mold part with the paste-like mass. For example, the chamber can initially be filled with a warm heat transfer medium which surrounds the at least one flexible mold part and heats the flexible mold part together with the paste-like mass which may already been added. Alternatively or subsequently, the chamber can be filled with a cold heat transfer medium, for example, to facilitate the solidification of the paste-like mass. Alternatively, for example, the warm heat transfer medium can be cooled in the chamber.

The chamber of the device according to the invention is also designed in such a way that a negative pressure, by means of which the flexible mold part is expanded, can be produced in the chamber in order to remove the paste-like mass from the flexible mold part. Within the framework of the present invention, negative pressure describes any force which can act on the outside of the flexible mold part in order to expand the flexible mold part outwards. For example, the chamber can be filled with a gas or with a liquid and a negative pressure of this kind can be produced by pumping out part of the gas or part of the liquid respectively.

At this time, if the mold holder holds part of the flexible mold part, the part of the flexible mold part which is not held is expanded by the negative pressure. This expansion results in an intermediate space between the solidified paste-like mass—lipstick lead—and the at least one flexible mold part, thus enabling a removal device to engage with the lipstick lead without having to use force to push between the flexible mold part and the lipstick lead. The mold holder can then be moved away from the flexible mold part so that the flexible mold part is expanded fully, for example over the whole length, due to the negative pressure, and the lipstick lead can now be completely removed.

As a result of the interaction of the mold holder with the at least one flexible mold part and as the temperature of the chamber can be controlled by means of the heat transfer medium, and the possibility of producing a negative pressure in the chamber, the device according to the invention for the first time provides a device with which a lipstick lead with a continuous and smooth surface can be produced, and with a relatively short process time for the production and removal of the lipstick lead from the mold, and a low maintenance requirement.

In one embodiment, the device has a tube which opens out into the chamber via a first valve and with which the chamber can be filled with the heat transfer medium, and with the help of which the negative pressure can be produced in the chamber. In doing so the tube which opens out into the chamber opens out into the bottom third of the chamber. The valve can be a mechanical, electromechanical or electromagnetic valve for example.

In an alternative embodiment, the device has a first tube which opens out into the chamber via a first valve and with which the chamber can be filled with the heat transfer medium, and a second tube which opens out into the chamber via a second valve, with the help of which the negative pressure can be produced in the chamber. The first tube which opens out into the chamber and the second tube which opens out into the chamber open out into the chamber at heights which are offset relative to one another. In doing so, for example, the first tube which opens out into the chamber opens out in the top third of the chamber in order to facilitate filling, and the second tube which opens out into the chamber opens out in the bottom third of the chamber to facilitate the production of the negative pressure. However, it is also contemplated that the two tubes open out into the chamber at approximately the same height. The valves can be mechanical, electromechanical or electromagnetic valves for example.

In a further embodiment, the mold holder consists of at least two parts. However, other configurations are also contemplated. The mold holder can therefore also consist of any number of parts. With a two or multi-part design of the mold holder, the parts of the mold holder should have as small a clearance as possible in the position in which they surround the at least one flexible mold part, for example a clearance of less than or equal to 1 mm. The mold holder or the parts of the mold holder can be made from metal or a hard plastic for example.

In a still further embodiment, the device according to the invention furthermore has an actuating element which moves the mold holder relative to the flexible mold part. Here, the actuating element can be a V-shaped slider, for example, which pushes together the at least two parts of the mold holder, which can be pivotably arranged between the opening of the V-shaped slider, when the V-shaped slider is moved along the parts of the mold holder. However, the actuating element can also be an annular slider which pushes together the at least two parts of the mold holder when the annular slider is moved along the at least two parts of the mold holder. However, the actuating element can also be provided by a mechanism, a servo mechanism or hydraulic system, which brings about a movement of the mold holder or of the at least two or more parts of the mold holder.

In another embodiment, the at least one flexible mold part is made of an elastomer. Here, depending on the chemical composition of the paste-like mass, the elastomer can be matched accordingly, both with regards to the elastomer type, for example room-temperature vulcanizing (RTV) or high-temperature vulcanizing (HTV) or for processing in liquid form (LSR), and with regards to the Shore hardness. At the same time, the elastomer must be chosen so that, in conjunction with the paste-like mass used, a high molding accuracy, a high surface quality and the food-safety can be guaranteed in each case.

In a still further embodiment, the at least one flexible mold part is fixed to at least one wall of the chamber. This fixing can be arranged in such a way, for example, that the flexible mold seals an opening of the chamber. The fixing can be implemented by means of a clamp fixing, for example. The bottom part of the at least one flexible mold part can also be connected to the bottom wall of the chamber, for example, in order to prevent a lateral movement of the at least one flexible mold part. Thereby, the connection can be an adhesive connection, for example, or a projecting part of the wall can engage in a cutout in the at least one flexible mold part or vice versa or both. However, a clamp connection can also be provided here.

However, the object of producing a lipstick lead with a continuous and smooth surface, and with a relatively short process time for the production and removal from the mold of the lipstick lead with a low maintenance requirement is also achieved by the method according to the invention.

The method according to the invention for producing lipstick leads made of paste-like masses is realized by means of a device comprising a chamber, at least one flexible mold part, wherein the at least one flexible mold part is arranged in the chamber, and at least one mold holder. The method according to the invention has the following steps: Filling the chamber with a heat transfer medium and filling the flexible mold part with a paste-like mass, wherein these two steps can be carried out consecutively or simultaneously. In addition, the method comprises the step of moving the mold holder to the flexible mold part to hold the flexible mold part. Next follows the production of a negative pressure in the chamber to expand the part of the flexible mold part which is not held by the mold holder. In this state, a removal device can be arranged on the part of the at least partially solidified paste-like mass which is exposed in this way. This is followed by the movement of the mold holder away from the flexible mold part so that it no longer holds the flexible mold part, and the negative pressure expands the whole flexible mold part, and the at least partially solidified paste-like mass can be removed from the flexible mold part, for example with the help of a removal device.

In another embodiment of the method, an exchange of the heat transfer medium in the chamber takes place from a warm heat transfer medium to a cold heat transfer medium after or during the filling of the flexible mold part with the paste-like mass.

BRIEF DESCRIPTION OF THE DRAWINGS

The invention is explained in more detail below with reference to the embodiment shown in the figures, wherein.

DETAILED DESCRIPTION

Figure 1:
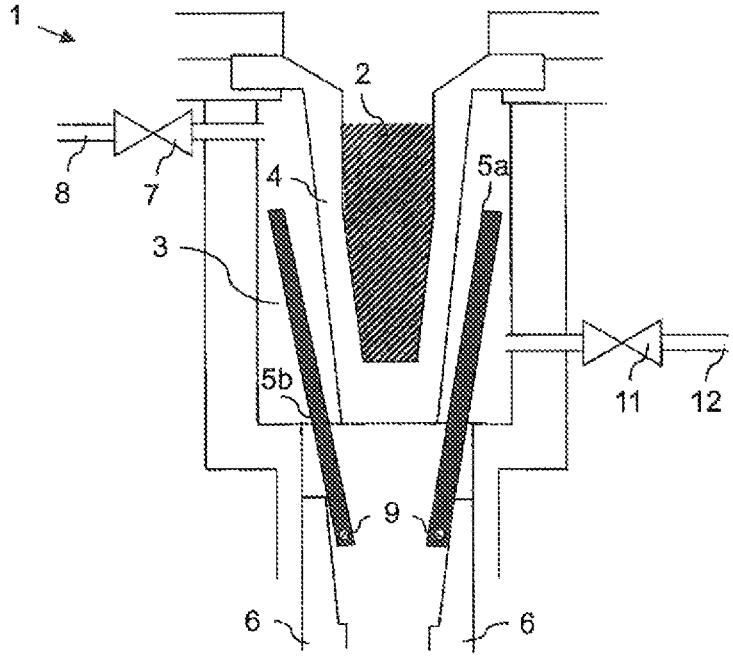
FIG. 1 shows a vertical section through an embodiment of the device according to the invention with the flexible mold filled.
Figure 2:
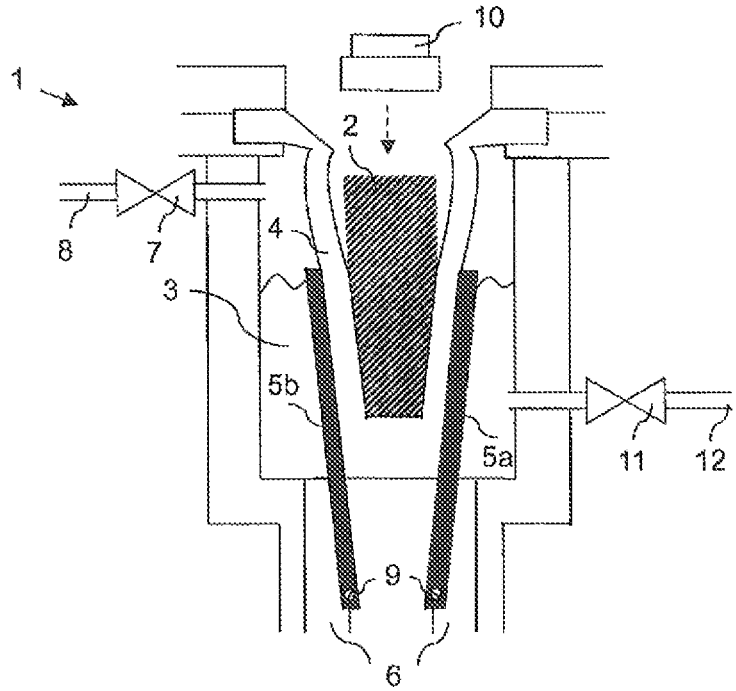
FIG. 2 shows a vertical section through the embodiment shown in FIG. 1 with a partially expanded flexible mold.

FIG. 1 shows a vertical section through an embodiment of the device 1 according to the invention for producing lipstick leads 2 with a flexible mold part 4 as a mold. The flexible mold part 4 is arranged in a chamber 3. In the embodiment shown in FIG. 1, the flexible mold part 4 seals the top part of the chamber 3. Here, the flexible mold part 4 is fixed in the upper region of the chamber 3 by means of a clamp connection. In this embodiment, the bottom part of the flexible mold part 4 contacts the wall of the chamber 3 in the lower region opposite the opening, where it can also be fixed. In the embodiment shown in FIG. 1, the flexible mold part 4 is already filled with the paste-like mass which, after settling, forms the lipstick lead 2. Furthermore, a mold holder, which, in the embodiment shown, consists of two parts 5*a*, 5*b*, is arranged in the chamber 3. However, the mold holder can also consist of more or fewer parts. The two parts 5*a*, 5*b* are designed in the form of half shells and can therefore positively encompass the flexible mold part 4 when the parts 5*a*, 5*b* in the form of half shells are moved towards one another. At the same time, the gap between the parts 5*a*, 5*b* is to be kept as small as possible, thus enabling the flexible mold part 4 to be encompassed in an optimal manner. In the embodiment shown in FIG. 1, the two parts 5*a*, 5*b* of the mold holder are open and do not rest against the flexible mold part 4. The parts 5*a*, 5*b* of the mold holder themselves are moved by means of an actuating element 6. Here, the actuating element 6 in the embodiment shown in FIG. 1 is realized by means of a V-shaped slider, and the two parts 5*a*, 5*b* of the mold holder are mounted on two pivot points 9, the pivot points 9 being arranged within the opening of the V-shaped slider. When the slider is in a bottom position, as shown in FIG. 1, then the two parts 5*a*, 5*b* of the mold holder can move about the pivot points 9 and hinge apart. When the V-shaped slider in the embodiment shown in FIG. 1 moves upwards, it pushes the parts 5*a*, 5*b* of the mold holder together as shown in FIG. 2. However, other actuating elements 6 known to the person skilled in the art can also be used for moving the parts 5*a*, 5*b* of the mold holder. For example, the two parts 5*a*, 5*b* of the mold holder shown in FIG. 1 can also be moved individually. The mold holder itself, or the parts 5*a*, 5*b* of the mold holder, can be made from a metal or a hard plastic.

In the embodiment shown in FIG. 1, the chamber 3 furthermore has two tubes 8, 12 which in each case open out into the chamber 3 via a valve 7, 11. Thereby, the chamber 3 can be filled with a heat transfer medium by ease of tube 8, and a negative pressure can be produced in the chamber 3 by ease of the other tube 12. Feeding in the heat transfer medium serves to pre-heat the flexible mold part 4 before the flexible mold part 4 is filled with the paste-like mass. Pre-heating the flexible mold part 4 enables an uncontrolled, usually sharply delimited solidification of the paste-like mass during the dosing process to be avoided. The mold holder, or the two parts 5*a*, 5*b* of the mold holder shown in FIG. 1, does not encompass the flexible mold part 4 at this time in order to guarantee a highest possible transfer of heat between heat transfer medium and the flexible mold part 4. When the paste-like mass has been added, the warm heat transfer medium can be replaced by a cold heat transfer medium to facilitate the solidification of the paste-like mass. Thereby, the mold holder, or the parts 5*a*, 5*b* of the mold holder, do not contact the flexible mold part 4 in order not to prevent a transfer of heat between the flexible mold part 4 and the heat transfer medium.

In the embodiment shown in FIG. 1, the two tubes 8, 12 open out into the chamber 3 at heights which are offset relative to one another.

FIG. 2 shows a vertical section through the embodiment shown in FIG. 1 with a partially expanded flexible mold part 4. In the embodiment shown in FIG. 2, the V-shaped slider, which constitutes the actuating element 6, is moved upwards and therefore pushes the parts 5*a*, 5*b* of the mold holder against the flexible mold part 4 so that the parts 5*a*, 5*b* of the mold holder positively contact the flexible mold part 4. In the position of the parts 5*a*, 5*b* of the mold holder shown in FIG. 2, these slightly compress the bottom part of the flexible mold part 4, thus holding the solidified paste-like mass.

If a negative pressure is now produced in the chamber 3 by means of the tube 12 which opens out into the chamber 3, for example by pumping out the heat transfer medium which is present in the chamber 3 while the valve 7 of the other tube 8 which opens out into the chamber 3 is closed, then the flexible mold part 4 is expanded in the region in which it is not encompassed by the mold holder or by the parts 5*a*, 5*b* of the mold holder. Expansion of the flexible mold part 4 in the upper region results in an intermediate space between the at least partially solidified paste-like mass and the flexible mold part 4, thus enabling a removal device 10 to engage without having to use force to push between the flexible mold part 4 and the solidified paste-like mass. As the bottom part of the flexible mold part 4 is securely held by the mold holder or by the parts 5*a*, 5*b* of the mold holder, the solidified paste-like mass cannot be pushed to the side when the removal device 10 engages, thus preventing deformation of or damage to the paste-like mass. Here, the removal device 10 can also be designed directly in the form of a cup known in lipsticks which is placed directly onto the solidified paste-like mass. In order to make removal easier and to create more space for the removal device 10, as an example, the flexible mold part 4 can also have two different zones of different ductility. For example, the top part of the flexible mold part 4 can be made softer than the bottom part and therefore stretched to a greater extent. This does not compromise the stability of the flexible mold part 4, as, when the flexible mold part 4 is filled with the paste-like mass, the chamber 3 is completely filled with the heat transfer medium and this therefore provides appropriate stability for the flexible mold part 4.

Figure 3:
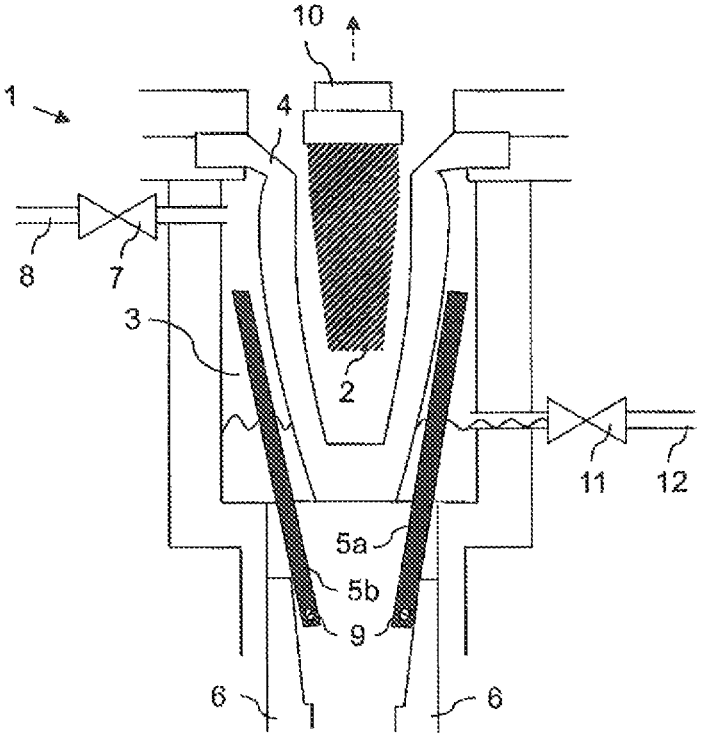
FIG. 3 shows a vertical section through the embodiment shown in FIG. 1 with a fully expanded flexible mold.

FIG. 3 shows a vertical section through the embodiment shown in FIG. 1 with a fully expanded flexible mold. In FIG. 3, the actuating element 6 in the form of the V-shaped slider has been moved downwards so that the parts of the mold holder 5*a*, 5*b* can move about their pivot points 9 and hinge apart so that the parts 5*a*, 5*b* of the mold holder no longer positively contact the flexible mold part 4. Because of the negative pressure which still exists in the chamber 3, the flexible mold part 4 is expanded over its entire length and the lipstick lead 2 is fully released. As a result, the lipstick lead 2 formed by the paste-like mass can be removed from the now expanded flexible mold part 4 with the help of the removal device 10.

The chamber 3 can then be refilled with the heat transfer medium via the tube 8 which opens out into the chamber 3, and a new process of filling the flexible mold part 4 with a paste-like mass can begin, thus enabling a further lipstick lead 2 to be molded.

The invention has been described in an illustrative manner, and it is to be understood that the terminology that has been used is intended to be in the nature of words of description rather than of limitation. Obviously, many modifications and variations of the present invention are possible in light of the above teachings. It is therefore to be understood that within the specification, the reference numerals are merely for convenience, and are not to be in any way limiting, the invention may be practiced otherwise than is specifically described.

The invention claimed is:

1. A device for the production of lipstick leads made of paste-like masses, comprising a chamber;

a flexible mold part, the flexible mold part being arranged in the chamber and the flexible mold part being designed in such a way that paste-like mass can be poured into the flexible mold part and can at least partially solidify in the flexible mold part and the at least partially solidified paste-like mass can be removed with a removal device while elastically expanding the flexible mold part;

a mold holder, wherein, when the device is used as intended, the mold holder is arranged for at least some of the time and at least partially in the chamber and in doing so holds part of the flexible mold part and wherein the mold holder can be moved relative to the flexible mold part; and the chamber is designed in such a way that the chamber can be filled with a heat transfer medium before and/or during the filling of the flexible mold part with the paste-like mass, and a negative pressure, by means of which the flexible mold part is expanded, can be produced in the chamber in order to remove the paste-like mass from the flexible mold part.

2. The device according to claim 1, further comprising a first tube which opens out into the chamber via a first valve and by means of which the chamber can be filled with the heat transfer medium and by means of which the negative pressure can be produced in the chamber.

3. The device according to claim 1, further comprising a first tube which opens out into the chamber via a first valve and by means of which the chamber can be filled with the heat transfer medium, and a second tube which opens out into the chamber via a second valve, and by means of which the negative pressure can be produced in the chamber.

4. The device according to claim 3, wherein the first tube which opens out into the chamber and the second tube which opens out into the chamber open out into the chamber at heights which are offset relative to one another.

5. The device according to claim 1, wherein the mold holder consists of at least two parts.

6. The device according to claim 1, further comprising an actuating element which moves the mold holder relative to the flexible mold part.

7. The device according to claim 1, wherein the flexible mold part is made of an elastomer.

8. The device according to claim 1, wherein the flexible mold part is fixed to at least one wall of the chamber.

9. A method for producing lipstick leads made of paste-like masses with a device comprising a chamber, a flexible mold part, wherein the flexible mold part is arranged in the chamber, and a mold holder, the method comprising the following steps:

filling the chamber with a heat transfer medium;

filling the flexible mold part with a paste-like mass;

moving the mold holder to the flexible mold part to hold the flexible mold part;

producing a negative pressure in the chamber to expand a part of the flexible mold part which is not held by the mold holder;

moving the mold holder away from the flexible mold part so that it no longer holds the flexible mold part, and the negative pressure expands the entire flexible mold part; and removing the at least partially solidified paste-like mass from the flexible mold part.

10. The method according to claim 9, further comprising:

exchanging the heat transfer medium in the chamber from a warm heat transfer medium to a cold heat transfer medium after or during the filling of the flexible mold part with the paste-like mass.

* * * * *